US005511836A

United States Patent [19]

Murphy

[11] Patent Number: 5,511,836

[45] Date of Patent: Apr. 30, 1996

[54] SECURITY DEVICE FOR BULKHEAD DOORS

[76] Inventor: Gerald K. Murphy, 20 Old Waquoit Rd., East Falmouth, Mass. 02536

[21] Appl. No.: 404,365

[22] Filed: Mar. 15, 1995

[51] Int. Cl.[6] ..... E05C 19/18

[52] U.S. Cl. ..... 292/259 R; 292/DIG. 21

[58] Field of Search ..... 292/259 R, 288, 292/289, DIG. 21

[56] References Cited

U.S. PATENT DOCUMENTS

| | | | |
|---|---|---|---|
| 1,687,538 | 10/1928 | Bradbury | 292/259 R |
| 2,130,216 | 9/1938 | Zaninovich | 292/259 R |
| 3,819,216 | 6/1974 | Richardson | 292/259 R |
| 4,852,921 | 8/1989 | Gilbert et al. | 292/259 R |
| 4,856,831 | 8/1989 | Roden, Jr. | 292/288 X |

FOREIGN PATENT DOCUMENTS

| | | | |
|---|---|---|---|
| 2562941 | 10/1985 | France | 292/288 |
| 14814 | 9/1881 | Germany | 292/259 |

*Primary Examiner*—Rodney M. Lindsey
*Attorney, Agent, or Firm*—Cesari and McKenna

[57] ABSTRACT

A device for securing bulkhead doors consists of a single length of rigid, angled metal bar stock that preferably extends across the full internal width of the doors. A pair of elastomeric bumpers located at each end of the bar make contact with the underside of the bulkhead doors or the side pillars on which the doors rest. The bar is braced against the doors by engagement with a retention bracket, which may be the existing bracket already associated with the bulkhead doors.

9 Claims, 6 Drawing Sheets

SECURITY DEVICE FOR BULKHEAD DOORS

BACKGROUND OF THE INVENTION

1. Field of the Invention

The present invention relates to security devices, and more particularly to a latching bar for securing bulkhead-type basement-entry doors.

2. Description of the Related Art

Homes with below-grade basements have traditionally been provided with some form of direct access to the outside, both to facilitate retrieval of large items (such as seasonal outdoor furniture, gardening equipment, sleds, bicycles, etc.) stored in the basement, as well as to limit foot traffic through first-floor rooms. The most common arrangement involves a pair of large, sloped "bulkhead" doors, installed against an exterior wall and covering a masonry enclosure extending away from the foundation. The enclosure includes a stairwell leading to the basement through a portal in the foundation. The portal ordinarily extends down to the basement floor, and is tall enough for convenient walk-through access to the stairwell. A slanted profile is preferred for the doors so that rain is shed instead of accumulating thereon.

Such an arrangement, indicated generally at reference numeral 10, appears in FIG. 1. A shell having a base 12 and sloping side walls 14 overlies a set of stairs leading to the basement. Covering the entryway defined by walls 14 is a face defined by a pair of overlapping leaf doors 18, 20 that rest against side pillars and a lintel that form, with base 12, a border frame 22. Both doors are affixed to walls 14 by oppositely disposed, concealed hinges (not shown), inaccessible from the exterior, that allow each door to swing open so as to expose the entryway. The outer door (door 20 in the representative illustration) is provided with a grip handle 24 that is lifted to open the door. Molded into door 20 is a recessed channel 26, which overlaps a flange (not shown) running along the length of door 18. In this way, the inner door 18 is prevented from opening unless outer door 20 is opened first. The flange also extends below the face of door 18 for reasons discussed below.

A typical latching mechanism for doors 18, 20 is also shown in FIG. 1. That mechanism consists of a retention bracket 30, welded to the inner face of door 20 near the edge that runs along door 18, and a steel rod 32 with 90° bends that extend in opposite directions to form a pair of coplanar end segments 32*a*, 32*b*. Rod 32 extends movably through opposed apertures in bracket 30; a sufficent length of rod 32 intervenes between the two bends to permit rod 32 to slide back and forth. In a locked position (shown in FIG. 1), the center portion of rod 32 rests against the bottom edge of the flange beneath door 18 and end portion 32*a* binds against the far wall of the flange, while in a retracted position the entire rod 32 underlies door 20, freeing door 18 to open. To latch the doors, a user accesses the locking mechanism from the stairwell, slides rod 32 into the extended position and rotates end portion 32*b* so that it binds against the flange; this contact prevents door 20 from opening, while the upper edge of the flange, trapped within channel 26, prevents door 18 from opening. To unlatch the doors, the user flips end portion 32*b* to disengage end portion 32*a* and slides rod 32 to its retracted position.

While simple and easily operated, this latching mechanism may be defeated under some circumstances. Loose contact between rod end portion 32*a* and the flange of door 18 allows door 20 to be lifted beyond the upper edge of the flange to expose a gap between the doors. If the play between doors is sufficient, the exposed gap will admit a rod or other elongated instrument that can be used to flip and slide end portion 32*b*. Persistent jostling of loosely latched doors can also disengage end portion 32*a* from the flange of door 18.

Moreover, because rod 32 makes contact only with closely spaced-apart portions of doors 18 and 20, lifting of door 20 exerts substantial torque on the hinges of both doors. This further contributes to an intruder's ability to disrupt contact between rod 32 and door 18.

DESCRIPTION OF THE INVENTION

BRIEF SUMMARY OF THE INVENTION

The present invention provides an improved latching mechanism for bulkhead doors that is as easily employed, but far more reliable, than the traditional mechanism discussed above. Moreover, the invention has been designed to utilize the retention bracket associated with an existing latch.

In accordance with the invention, a single length of rigid, angled metal bar stock extends across the full internal width of the bulkhead doors. A pair of elastomeric bumpers located at each end of the bar make contact with the underside of the side pillars on which the doors rest. The bar is braced against the doors by engagement with a bracket. Preferably, this is the existing retention bracket already associated with the outer bulkhead door (from which the rod has been removed), and the bar is provided with means for engaging the bracket to retain the bar in place. The bar is conveniently used and, because of its full span across the doors, provides secure resistance to their opening that is not compromised by play in the doors. Furthermore, the bar is not readily dislodged from the door bracket even if attempts are made to pry the doors apart; greater prying force drives the bumpers even more securely against the underside of the pillars.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENT

Figure 2:
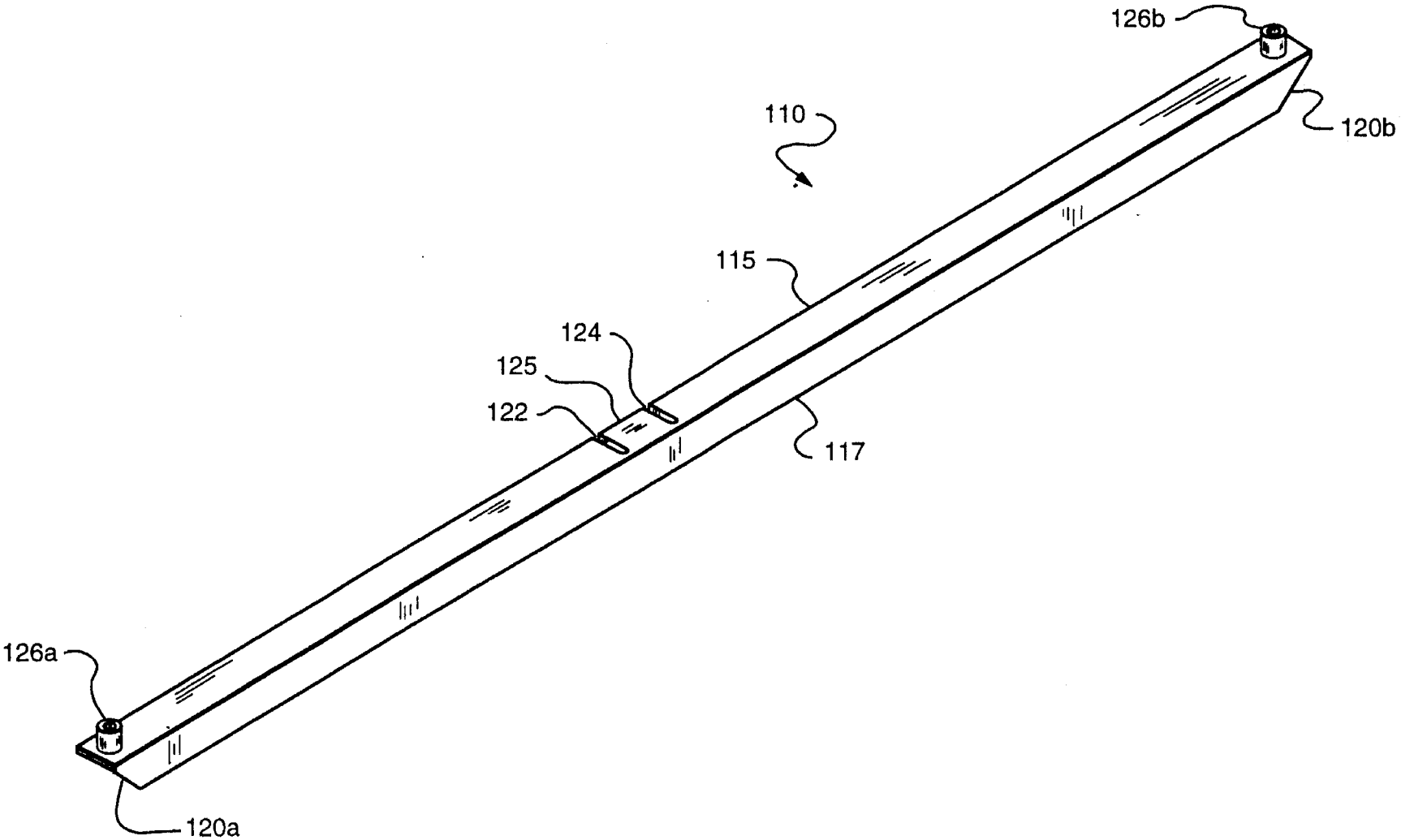
FIG. 2 is an isometric view of a security device in accordance with the present invention.
Figure 6:
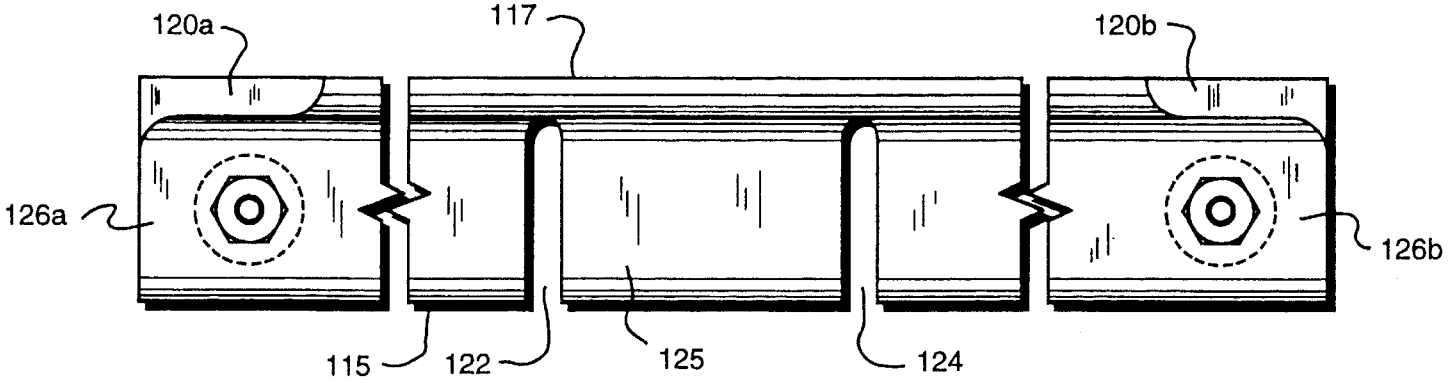
FIG. 6 is a bottom view thereof.
Figure 3:
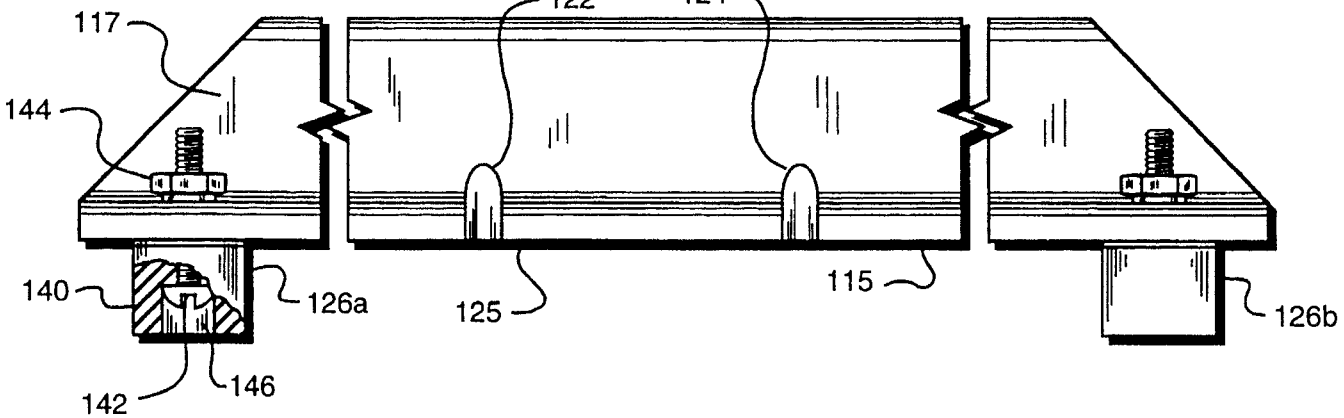
FIG. 3 is a reversed elevation thereof.
Figure 4:
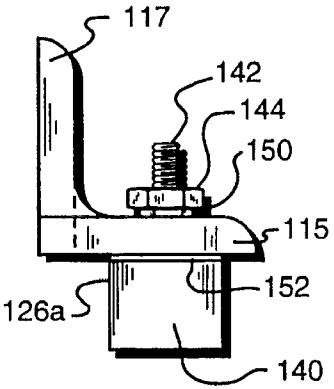
FIG. 4 is a reversed side elevation thereof.
Figure 7:
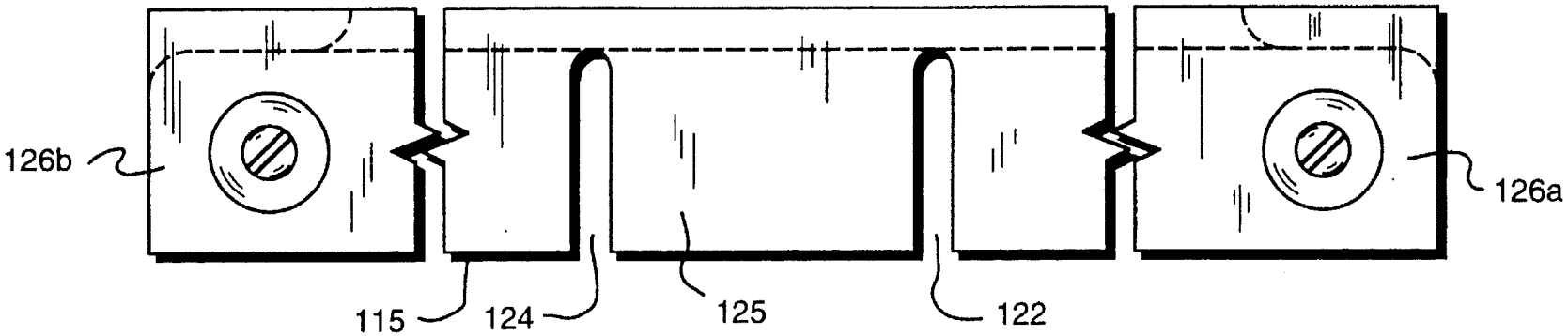
FIG. 7 is a plan view thereof.
Figure 5:
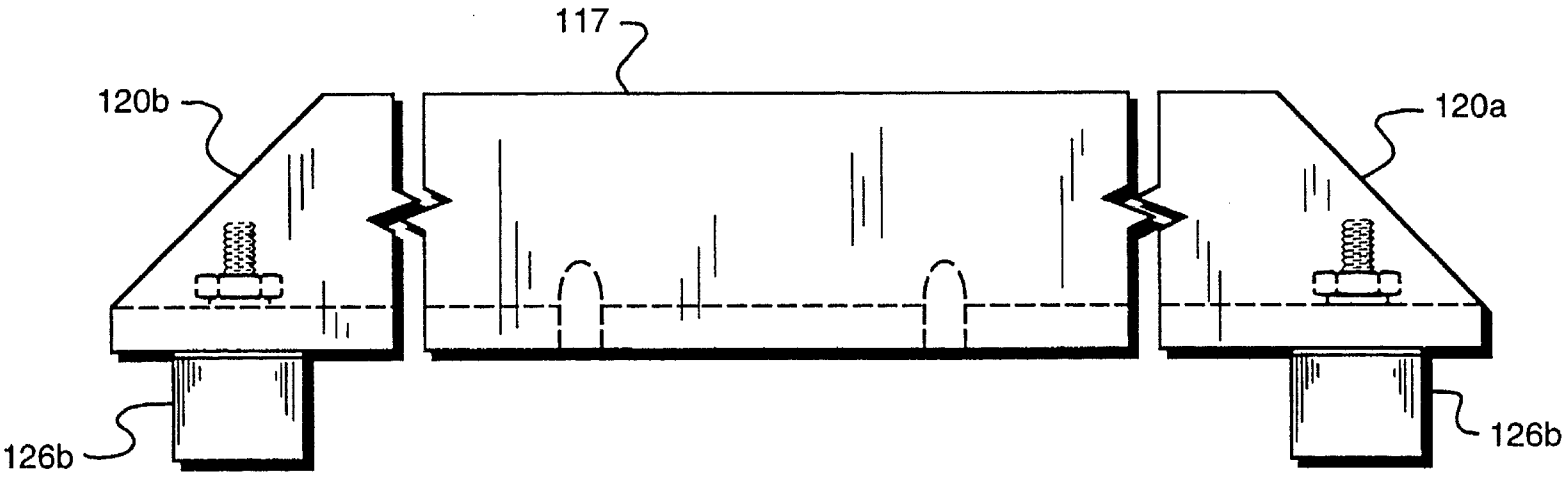
FIG. 5 is a reversed rear elevation thereof.

Refer now to FIG. 2, which illustrates a preferred form of security device 110. The device comprises a single elongated length of rigid, angled metal bar stock having a first face 115 that serves as an engagement shoulder and a second face 117, integral with but forming an angle (preferably 90°) with face 115. The angled profile of bar 110, shown most clearly in FIG. 4, confers substantial beam strength against the bending forces exerted by efforts to pry secured bulkhead doors apart, as explained in fuller detail below. The angled design permits the device 110 to be manufactured from lightweight materials, such as aluminum, without compromising the device's effectiveness.

The ends 120*a*, 120*b* of face 117 are preferably cut in at an angle, both to facilitate installation and to minimize the presence of needless sharp corners. Face 115 includes a pair of parallel notches or slots 122, 124 that extend transversely through the face and form a tab 125. A pair of bumper assemblies 126*a*, 126*b* are located at each end of face 115.

The components of these assemblies appear in FIGS. 3–7. Each assembly includes a partially hollow elastomeric bumper pad 140 secured to face 115 by a bolt 142 passing through an aperture (not shown) in face 115 and a nut 144 threaded onto the bolt. The hollow 146 of bumper pad 140 (see FIG. 3) includes a seat against which the head of bolt 142 rests. Preferably, loosening of nut 144 is prevented by interposing a lock washer 150 (see FIG. 4) between the nut and face 125. When necessary, one or more spacing washers 152 can be located between face 115 and bumper pad 140 to create an optimal fit; these are preferably diametrically coextensive with bumper pad 140.

Figure 1:
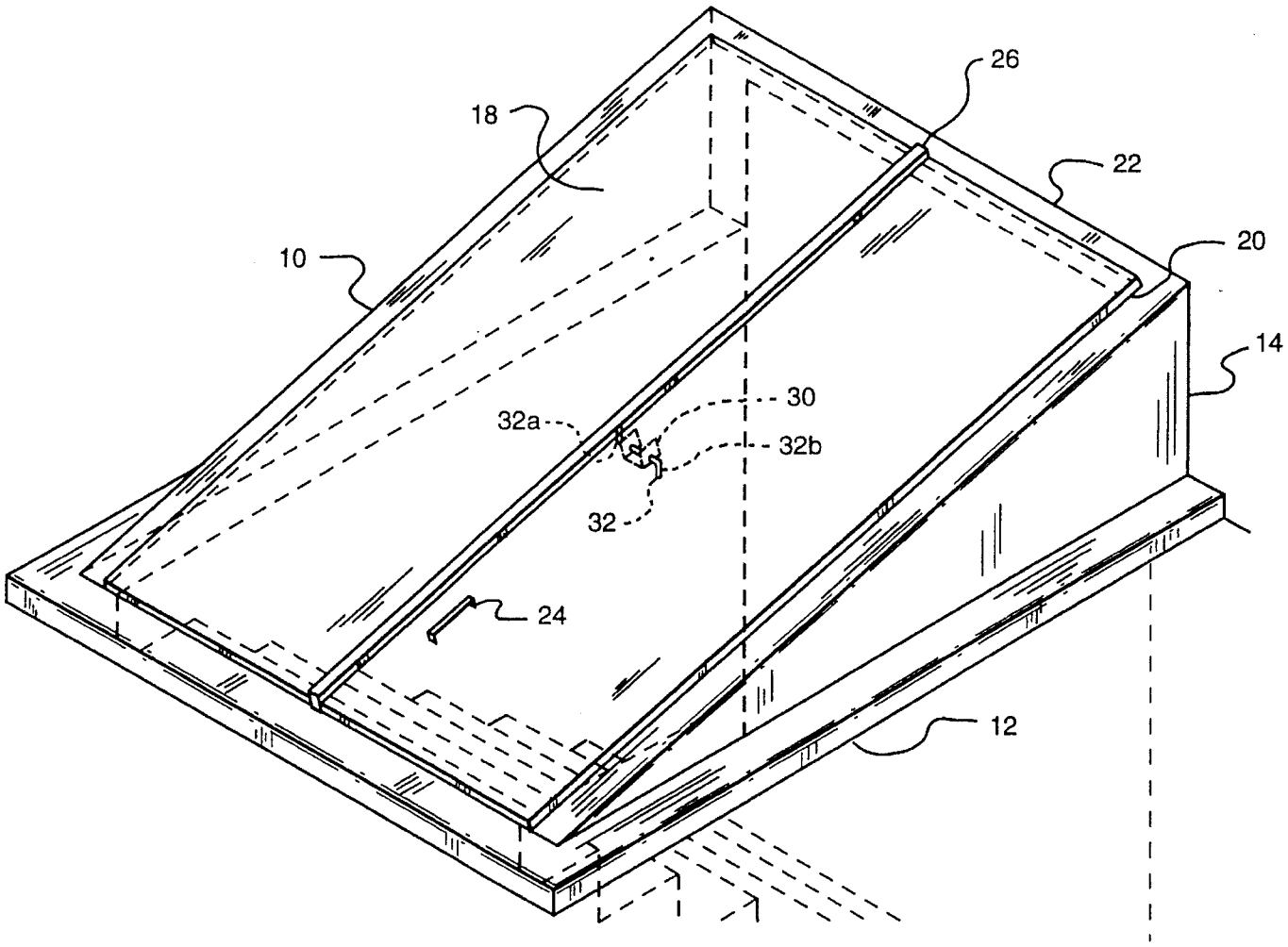
FIG. 1 (PRIOR ART)
FIG. 1, already described, is an isometric view of a typical bulkhead-door arrangement that utilizes a traditional latching mechanism.
Figure 8:
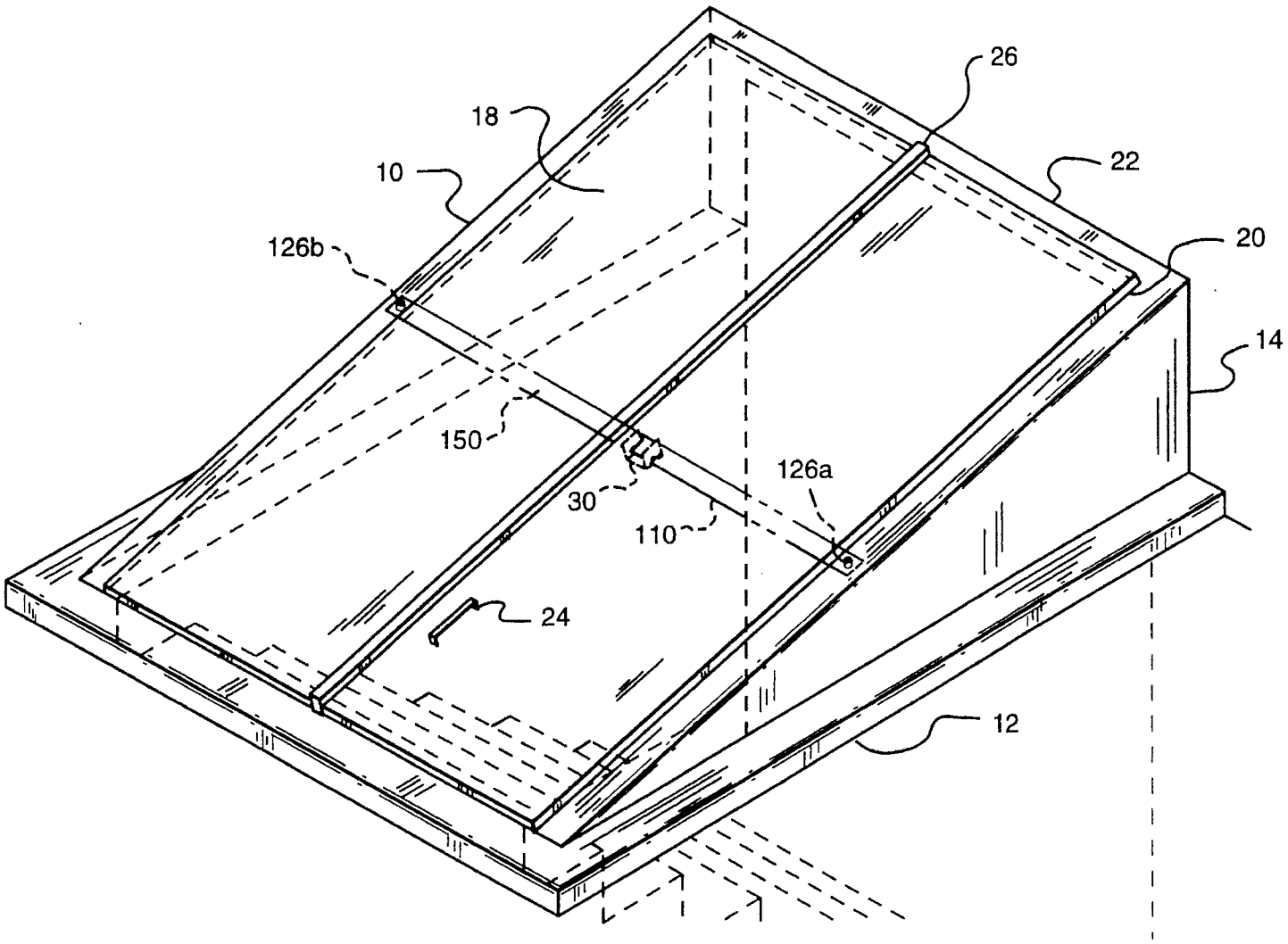
FIG. 8 shows the invention secured to an existing bulkhead-door arrangement.

FIG. 8 shows the bar 110 installed on existing set of bulkhead doors 10. The rod 32 (see FIG. 1) has been removed from bracket 30, the sides of which are received within the bar slots 122, 124. The end faces of bumper assemblies 126*a*, 126*b* rest firmly against the underside of the pillars of border frame 22. Preferably, the overall height of bumper assemblies 126*a*, 126*b* (including any spacer washers 152) is such that tab 125 rests firmly against the bottom wall of bracket 30, thereby eliminating play and making it difficult to dislodge bar 110 even if access between doors 18, 20 is obtained.

Figure 9:
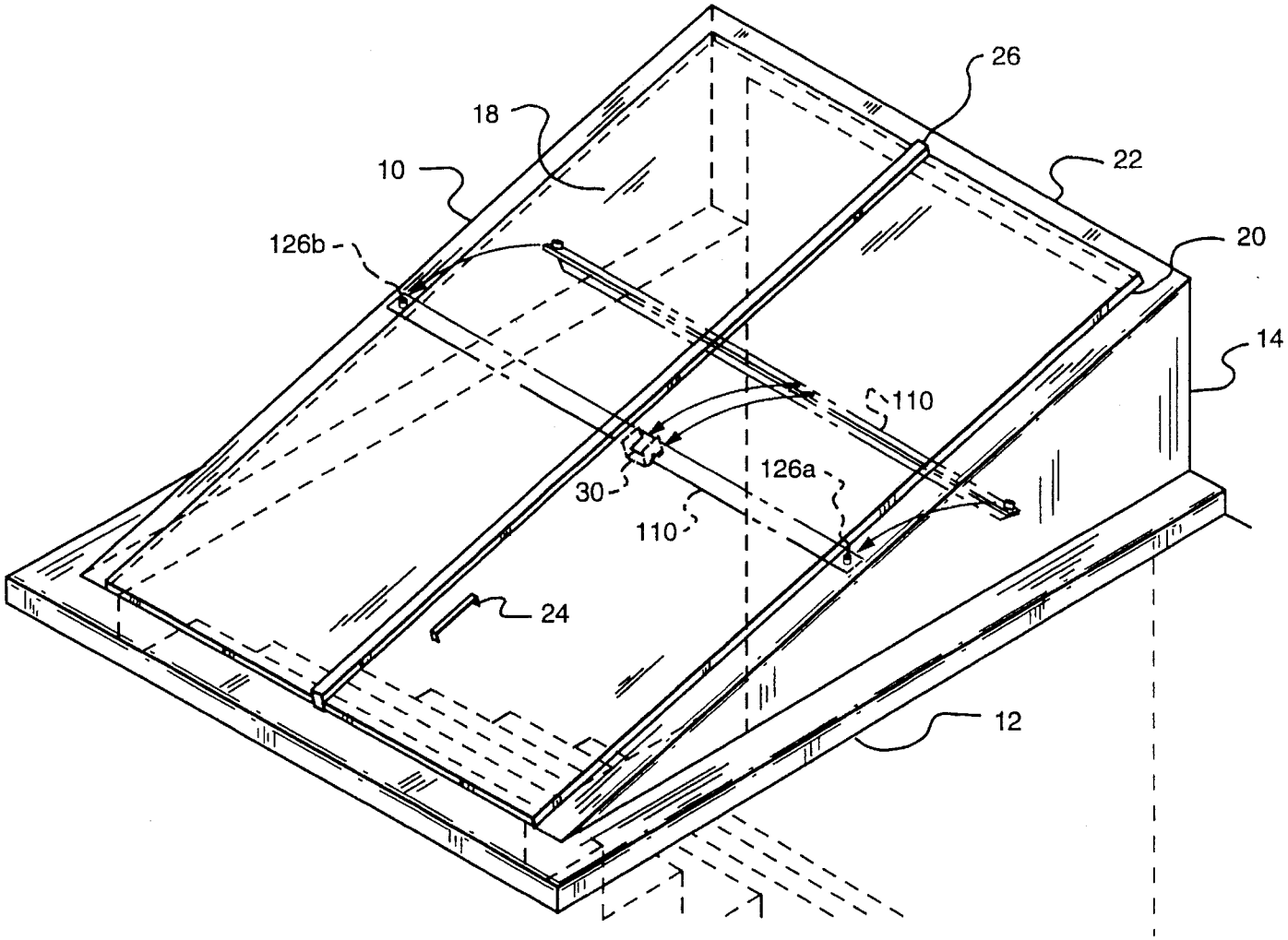
FIG. 9 illustrates the manner in which the security device is installed.

The manner of installation is shown in FIG. 9. Bar 110 is positioned just above or in front of bracket 30, with the end faces of bumper assemblies 126*a*, 126*b* contacting the undersides of the side pillars of border frame 22. Bar 110 is then raised so as to slightly compress bumper assemblies 126*a*, 126*b*, thereby bringing tab 25 above the bottom shelf of bracket 30 so that the sides of bracket 30 are received in bar slots 122, 124.

In a representative embodiment, bar 110 is fabricated from ¼" aluminum stock. Faces 115, 117 are each 1½" deep, and the bar 110 is long enough to allow bumper assemblies 126*a*, 126*b* to make contact with the undersides of the side pillars.

It will therefore be seen that the foregoing represents a highly advantageous and convenient approach to latching of bulkhead doors, which lends itself to retrofitting on existing door sets. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed. For example, it is not necessary to utilize an existing bulkhead-door retention bracket to secure bar 110 to the doors. Instead, slots 122, 124 can be eliminated and bar 110 removably affixed to the doors by other means; for example, the bar can be retained on a welded shelf or on support rods that depend from the underside of outer door 20. 0f course, if doors 18, 20 do not overlap, bar 110 should be removably affixed by similar means to both doors. In addition, bar 110 can be permanently mounted to the inner door on a pivot 150, so that the user can rotate the bar into and out of engagement with the bracket on the outer door without physically removing the bar.

What is claimed is:

1. In a bulkhead closure that includes a pair of doors having inside surfaces and outside surfaces and which is hinged to a pair of spaced-apart parallel side pillars so that the doors open out from closed positions to open positions:

a. a rigid bar, the bar being longer than the distance between side pillars;

b. contact means located at each end of the bar for engaging the pillars, each contact means having a separately adjustable extension from the bar; and c. bar-retention means including a retainer bracket mounted to the inside surface of at least one of the doors, the bar comprising slots for receiving the retainer bracket and being movable into engagement therewith so that a flat surface of the bar rests against a flat surface of the retainer bracket, and the bar extends generally perpendicular to the side pillars and bridges the pair of doors.

2. The closure of claim 1 wherein the bar comprises a pair of spaced-apart resilient bumpers for retaining the engaged bar firmly in place.

3. The closure of claim 1 wherein:

a. the doors in their closed positions overlap so that there is an outer door and an inner door; and b. the retention means includes a retainer bracket mounted to the inside surface of the outer door.

4. The closure of claim 3 further comprising means for pivotally connecting the bar to the inside surface of the doors so that the bar can be pivoted into engagement with the retainer bracket.

5. The closure of claim 1 wherein the bar is metal.

6. The closure of claim 5 wherein the metal is aluminum.

7. The closure of claim 1 wherein the bar is an angle iron comprising first and second body segments disposed at an angle to one another.

8. The closure of claim 7 wherein the angle between the first and second body segments is 90°.

9. In a bulkhead closure that includes a pair of doors having inside surfaces and outside surfaces and which are hinged to a pair of spaced-apart parallel side pillars so that the doors open out from closed positions to open positions:

a. a rigid bar, the bar being longer than the distance between side pillars;

b. contact means located at each end of the bar for engaging the pillars, each contact means having a separately adjustable extension from the bar; and c. means for pivotally connecting the bar to one of the doors so that the bar can be pivoted to engage the contact means against the pillars when the doors are in their closed positions.

* * * * *